US007523786B2

(12) United States Patent
Rose

(10) Patent No.: US 7,523,786 B2
(45) Date of Patent: Apr. 28, 2009

(54) APPARATUS AND METHOD FOR FREEING DEPLOYMENT CABLES STUCK IN A WELLBORE

(76) Inventor: Dwight Rose, 2708 Lawrence, Nederland, TX (US) 77627

( * ) Notice: Subject to any disclaimer, the term of this patent is extended or adjusted under 35 U.S.C. 154(b) by 0 days.

(21) Appl. No.: 11/846,354

(22) Filed: Aug. 28, 2007

(65) Prior Publication Data

US 2008/0047710 A1 Feb. 28, 2008

Related U.S. Application Data

(60) Provisional application No. 60/840,669, filed on Aug. 28, 2006.

(51) Int. Cl.
*E21B 31/00* (2006.01)

(52) U.S. Cl. ..... 166/301; 166/99; 166/178

(58) Field of Classification Search ..... 166/301, 166/98, 99, 178
See application file for complete search history.

(56) References Cited

U.S. PATENT DOCUMENTS

| | | | | |
|---|---|---|---|---|
| 1,347,203 | A | 7/1920 | Borough | |
| 1,362,883 | A | 12/1920 | McMillian et al. | |
| 2,089,857 | A | 8/1937 | Robbins | |
| 3,058,386 | A | 10/1962 | Morrow | |
| 3,342,266 | A * | 9/1967 | Le Blanc | 166/301 |
| 3,358,765 | A | 12/1967 | Le Blanc | |
| 4,078,277 | A | 3/1978 | McCracken | |
| 4,108,245 | A | 8/1978 | Babineaux | |
| 4,397,494 | A | 8/1983 | Carver | |
| 5,511,909 | A | 4/1996 | Calandra, Jr. | |
| 5,720,348 | A * | 2/1998 | Hisaw | 166/297 |
| 6,942,035 | B2 | 9/2005 | Sollesnes | |
| 2003/0047318 | A1 | 3/2003 | Cruickshank et al. | |

* cited by examiner

*Primary Examiner*—David J Bagnell
*Assistant Examiner*—Brad Harcourt
(74) *Attorney, Agent, or Firm*—Winstead PC; Henry L. Ehrlich

(57) ABSTRACT

An apparatus for freeing a cable that is lodged in a wellbore without dislodging the well tool carried by cable includes a housing connectable about the cable and means for engaging the cable upon impact with the well tool to reduce the impact of the outer housing on the well tool.

13 Claims, 5 Drawing Sheets

66
30
62
68
10

66
30
62
68
10

66
30
62
68
10

APPARATUS AND METHOD FOR FREEING DEPLOYMENT CABLES STUCK IN A WELLBORE

RELATED APPLICATIONS

This application claims the benefit of U.S. Provisional Patent Application No. 60/840,669 filed on Aug. 28, 2006.

FIELD

The present invention relates in general to wellbore operations and more specifically to an apparatus and method for releasing a cable deployed wellbore tool stuck in the wellbore without detaching the wellbore tool from the cable.

BACKGROUND

Wellbore operations often utilize wellbore tools deployed on cables, including without limitation wirelines and slick lines. For example, well logging operations commonly utilize a logging tool deployed in the wellbore on an electric wireline. A common problem that occurs in these operations is that the cable gets stuck in the wellbore. Sticking of the cable, as opposed to the wellbore tool, often occurs due to being key-seated or differentially stuck. Key seated commonly refers to situations, such as in deviated wells, where the cable digs into the wall of the wellbore to a sufficient depth that the attached tool can no longer be moved in the wellbore. When the cable is differentially stuck, the wellbore pressure is greater than the formation pressure resulting in the cable essentially being sucked to the wellbore wall. The cable may penetrate into the wall or be stuck by virtue of the friction and drag of the cable on the wall.

Once stuck, the first objective is to free the tool as quickly as possible. Thus, the first step is to pull on the cable. However, this often results in the cable parting requiring that fishing operations commence. Fishing operations result in significant lost time and increased operation costs. Another solution in the past has been to run, or essentially free-fall, a bar or pipe sub over the cable to the tool. Unfortunately, while this method may free the cable, when the sub impacts the tool, the force of the impact detaches the wellbore tool from the cable. Again, this results in fishing operations.

Therefore, it is a desire of the present invention to provide a method and apparatus for releasing a cable stuck in a wellbore without detaching the connected wellbore tool.

SUMMARY

In view of the foregoing and other considerations, the present invention relates to wellbore operations and more specifically to methods and systems for freeing deployment cables that are stuck or lodged in a wellbore without releasing a well tool from the deployment cable.

An apparatus for freeing a cable that is lodged in a wellbore without dislodging the well tool carried by cable includes a housing connectable about the cable and means for engaging the cable upon impact with the well tool to reduce the impact of the outer housing on the well tool.

A method of freeing a cable lodged in a wellbore that is suspending a well tool in the wellbore includes the steps of disposing a device about the cable, releasing the device to travel down the cable toward the suspended well tool, and engaging the cable with the device substantially eliminating the impact of the device on the suspended well tool.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
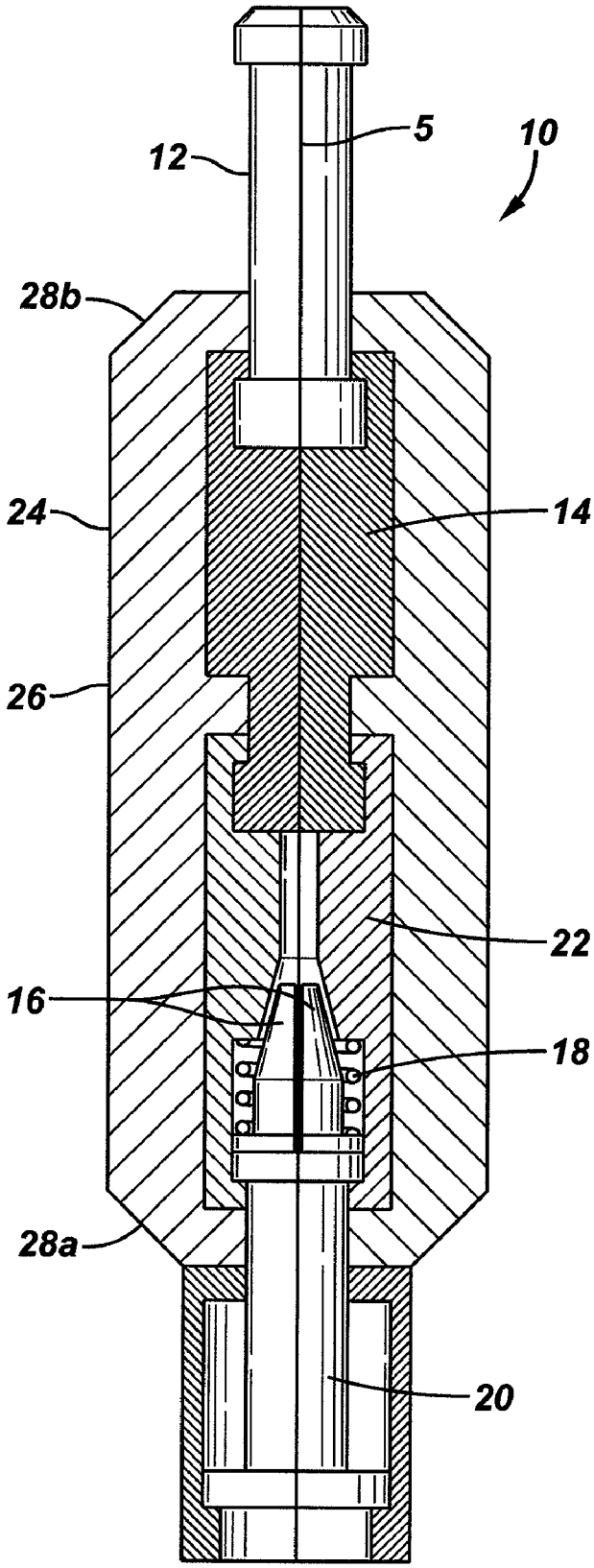
FIG. 1 is a side view of a cable release tool of the present invention for releasing a deployment cable that is lodged in a wellbore.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a side view of a cable release tool of the present invention, generally denoted by the numeral 10. Cable tool 10 includes a fishing neck 12, medial guide 14, slips 16, biasing mechanism 18, plunger 20, slip housing 22 and outer housing 24. The elements are interconnectable for attaching about a deployment cable 30 (FIGS. 2-5).

Figure 2:
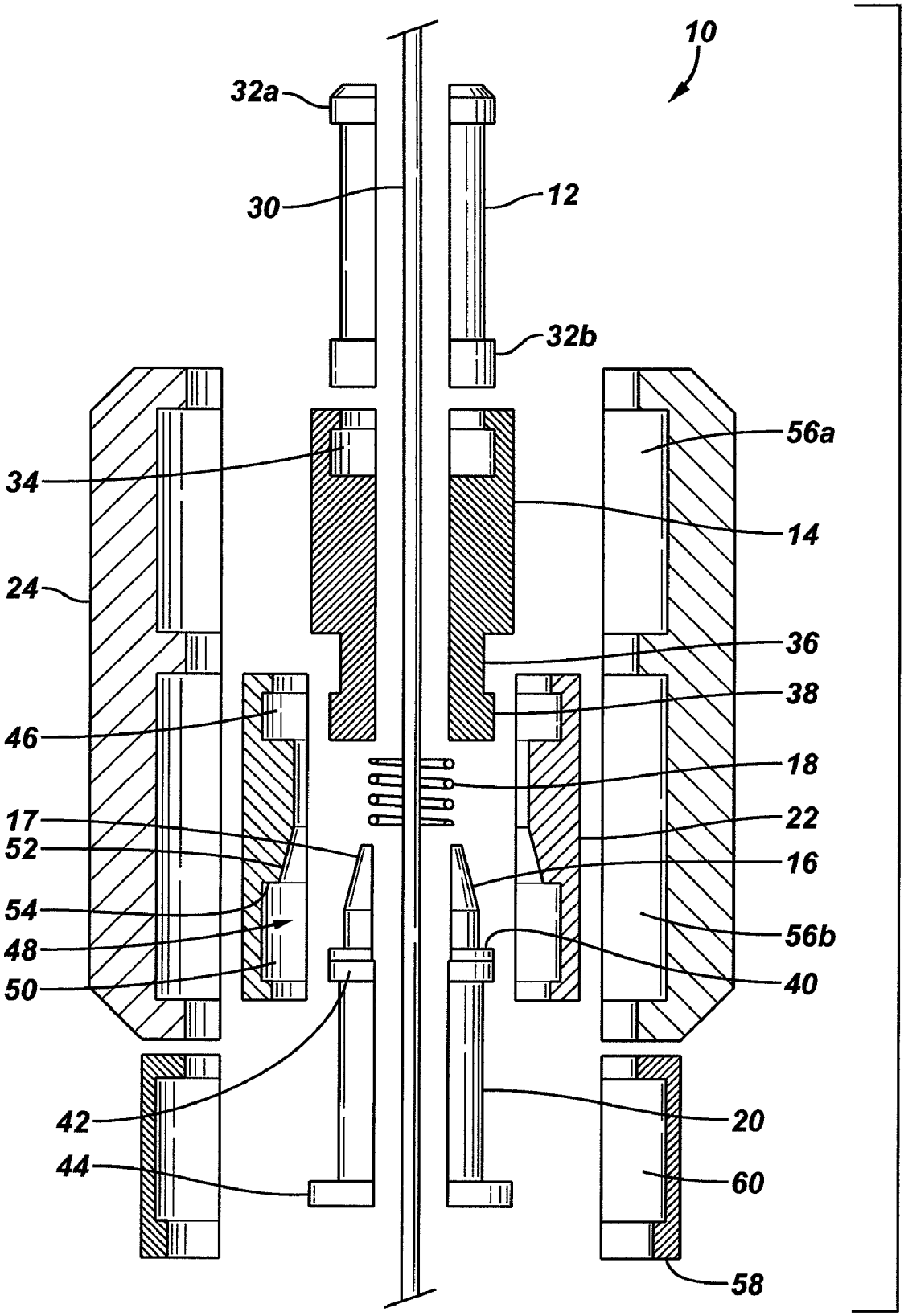
FIG. 2 is an exploded view of a cable release tool of the present invention.

The members may be formed in halves as shown in FIG. 2, or sections, for interconnection about cable 30. Cable tool 10 may be formed as a substantially unitary piece. It will become apparent from the further description that the member halves may be connected to each other by various means including threading or bolts and/or interconnected via outer housing 24. It should be further noted, that some elements depicted may be eliminated without departing from the scope of the invention.

For purposes of description, fishing neck 12 is the top end of cable tool 10 oriented toward the surface. Fishing neck 12 provides a means for retrieving cable tool 10 if fishing operations are required.

Outer housing 24 has an outer surface 26. Desirably outer surface is formed, or contoured, to aid tool 10 to contact the wall of the wellbore without sticking or digging into the wall when it is being run into or out of the wellbore. For example, outer surface 26 may be curved as illustrated in FIG. 5. In the example shown in FIGS. 1-4, outer surface 24 may have tapered, opposing ends 28*a*, 28*b*. Tapered ends 28*a* and 28*b* are tapered inward toward seam 5. Seam 5 represents the longitudinal axis of tool 10 and in the illustrated example seam 5 represents the abutting halves of the various members. It is noted, that other elements such as centralizers of different constructions may be included to maintain tool 10 toward the center of the wellbore to help free cable 30.

Outer housing 24 may be utilized to carry the desired weight necessary to free the stuck cable. The weight of housing 24 may be determined by the construction and material of housing 24 and/or may include weight elements (not shown) that are connectable to outer housing 24.

FIG. 2 is an illustration of cable release tool 10 disassembled. Fishing neck 12 is placed around deployment cable 30 and the two halves are connected to one another by, for example, allen screws (not shown). Each half of fishing neck 12 includes an internal groove (not shown) for disposing cable 30. Fishing neck 12 has a top head 32*a* and a bottom head 32*b*.

Medial guide 14 includes an internal cable groove (not shown), head slot 34 and a leg 36 terminating at a foot 38. Medial guide 14 halves are secured together about cable 30 and with bottom head 32*b* disposed within head slot 34. Medial guide 14 may be disposed in a first or upper cavity 56*a* formed by outer housing 24.

Slips 16 are disposed around cable 30 and work in combination with slip housing 22 and plunger 20 to selectively grip and secure tool 10 to cable 30 when desired. Slips 16 desirably have a flanged base 40 and a conical or nose 17. Biasing mechanism 18 is illustrated as a spring but includes other biasing mechanisms. Biasing mechanism 18 urges slips 16 toward the disengaged position operating to prevent slips 16 from engaging cable 30 until engagement is desired.

Plunger 20 includes an upper flange 42 and a lower flange 44. Plunger 20 halves are interconnected about cable 30 disposed in an internal groove (not shown). Upper flange 42 is positioned for engaging flanged base 40 of slips 16. In the illustrated example, upper flange 42 has a smaller diameter than lower flange 44.

Slip housing 22 forms a foot slot 46 and a track 48 extending from a disengaged position to an engaged position. Track 48 includes a bottom chamber 50 and a tapered slip section 52 separated by a shoulder 54. Slip section 52 tapers down in diameter from proximate shoulder 54 toward foot slot 46. Slip housing 22 is positioned over cable 30 with foot 38 disposed within foot slot 46 and base flange 40 of slips 16 and upper flange 42 of plunger 20 disposed in chamber 50. Conical nose 17 of slips 16 is oriented toward slip section 52. Biasing mechanism 18, if included, is positioned between shoulder 54 and base 40 urging conical nose 17 out of engagement within slip section 52, until cable engagement and gripping is desired. Slip housing 22 may be disposed within a second or lower cavity 56*b* of outer housing 24.

Outer housing 24 is disposed over cable 30, part of fishing neck 12, medial guide 14, slip housing 22 and substantially all of plunger 20 and the sections of housing 24 are interconnected. Housing 24 further includes an open bottom end 58 in communication with a plunger chamber 60. Lower flange 44 of plunger 20 is movably disposed in chamber 60. Desirably, flange 44 is positioned proximate to open end 58 or extends outward of open end 58 when tool 10 is disengaged from cable 30.

Figure 3:
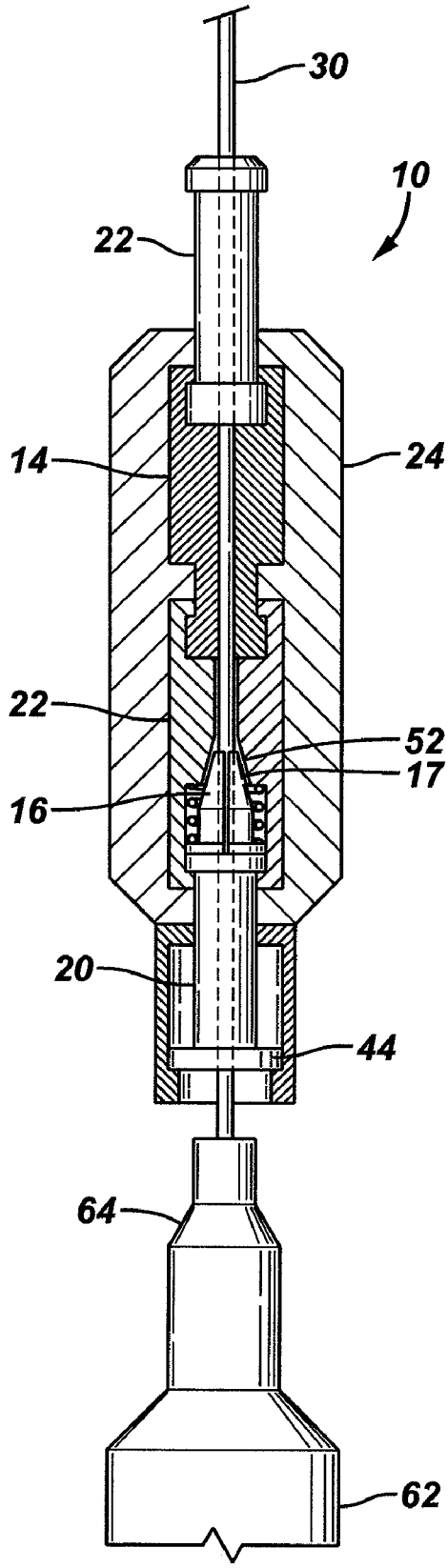
FIG. 3 is an illustration of a cable release tool in the disengaged position from movement along a deployment cable carrying a wellbore tool.

FIG. 3 is an illustration of cable tool 10 in the disengaged positioned attached to deployment cable 30 carrying a wellbore tool 62. In the disengaged position, slip nose 17 is urged out of engagement with slip section 52 of slip housing 22 permitting tool 10 to move down cable 30 toward wellbore tool 62.

Figure 4:
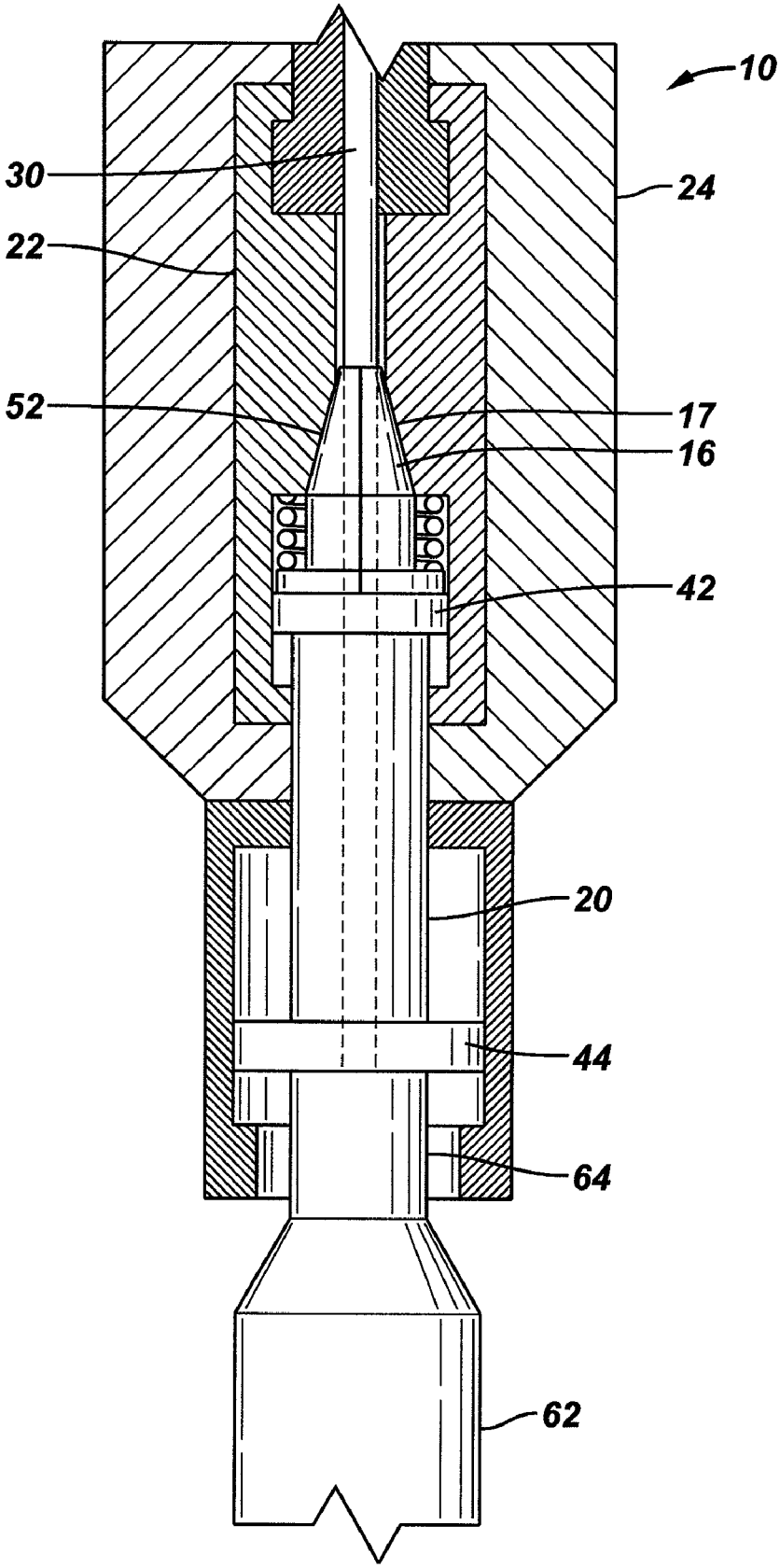
FIG. 4 is an illustration of a cable release tool in the engaged position, gripping the deployment cable.

Refer now to FIG. 4, wherein tool 10 is shown in gripping engagement of cable 30. Cable tool 10 travels down cable 30 and lower flange 44 of plunger 20 contacts head 64 of wellbore tool 62. Upon impact with wellbore tool 62, plunger 20 is forced upward pushing conical nose 17 of slips 16 into slip section 52 of slip housing 22. As conical nose 17 moves into tapered slip section 52, slips 16 are urged together and in gripping engagement with cable 30. Engagement of tool 10 with cable 30 limits the force of impact on wellbore tool 62.

Figures 5A, 5B, 5C:
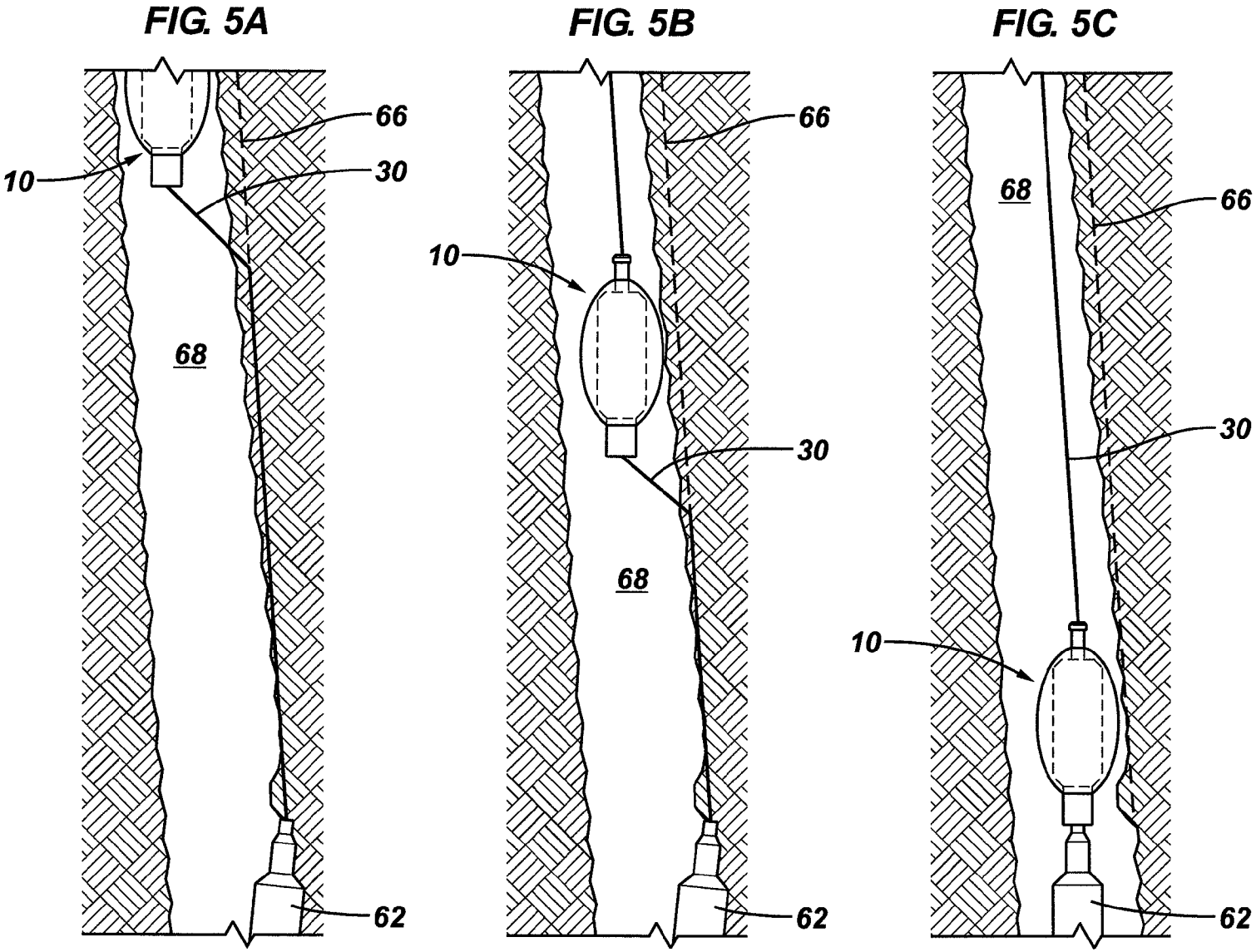
FIGS. 5A-5C illustrate a cable release tool freeing a well tool deployment cable that is stuck or lodged in a wellbore.

A method of operation of cable tool 10 is illustrated with reference to FIGS. 5A-5C. Deployment cable 30 is shown key-seated in the wall 66 of a wellbore 68. Cable tool 10 is connected to cable 30 as described in reference to FIGS. 1-3. Cable tool 10 is released and travels down cable 30 releasing cable 30 from engagement with wellbore wall 66. When cable tool 10 reaches wellbore tool 62 it engages cable 30 without detaching wellbore tool 62 from cable 30.

From the foregoing detailed description of specific embodiments of the invention, it should be apparent that a system for freeing a cable that is stuck in a wellbore without detaching a wellbore tool that is deployed by the cable that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An apparatus for freeing a cable that is stuck in a wellbore, the apparatus comprising:

a slip housing having an internal track;

slips positioned within the internal track and about the cable, the slips moveable along the track from a position disengaged from the cable permitting downward movement of the apparatus along the cable to an engaged position wherein the slips grip the cable preventing disconnection of a well tool from the cable by the apparatus; and a plunger positioned about the cable and having an end abutting the slips.

2. The apparatus of claim 1, further including:

a fishing neck; and a medial guide in connection between the fishing neck and the slip housing.

3. The apparatus of claim 1, further including a biasing mechanism urging the slips out of gripping engagement with the cable.

4. The apparatus of claim 2, further including a biasing mechanism urging the slips out of gripping engagement with the cable.

5. An apparatus for freeing a cable that is stuck in a wellbore, the apparatus comprising:

a slip housing having an internal track;

slips positioned within the internal track and about the cable, the slips moveable along the track from a position disengaged from the cable permitting downward movement of the apparatus along the cable to an engaged position wherein the slips grip the cable preventing disconnection of a well tool from the cable by the apparatus; and a biasing mechanism urging the slips out of gripping engagement with the cable.

6. The apparatus of claim 5, further including a plunger positioned about the cable and having an end abutting the slips.

7. A method of freeing a cable lodged in a wellbore that is suspending a well tool in the wellbore, the method comprising the steps of:

disposing a device about the cable;

releasing the device to travel down the cable toward the suspended well tool; and contacting the well tool with a portion of the device causing the device to engage the cable substantially eliminating the impact of the device on the suspended well tool without disconnecting the well tool from the cable.

8. The method of claim 7, wherein the device includes:

a slip housing having an internal track; and slips positioned within the internal track and about the cable, the slips moveable along the track from a positioned disengaged from the cable permitting movement of the apparatus along the cable to an engaged position wherein the slips grip the cable.

9. The method of claim 8, wherein the device further includes a plunger positioned about the cable and having an end abutting the slips.

10. The method of claim 9, wherein when the plunger impacts the well tool the plunger causes the slips to grip the cable.

11. The method of claim 8, wherein the device further includes a fishing neck, and a medial guide in connection between the fishing neck and the slip housing.

12. The method of claim 11, wherein the device further includes a plunger positioned about the cable and having an end abutting the slips.

13. The method of claim 12, wherein the step of engaging the cable includes the step of the plunger impacting the well tool and the plunger urging the slips into engagement with the cable.

* * * * *